United States Patent [19]

Logsdon

[11] 4,212,486

[45] Jul. 15, 1980

[54] WATER CLOSET PROTECTOR STABILIZER

[75] Inventor: Duane D. Logsdon, Fullerton, Calif.

[73] Assignee: The Logsdon Foundation, Stanton, Calif.

[21] Appl. No.: 907,509

[22] Filed: May 19, 1978

[51] Int. Cl.[2] ..... F16L 55/00

[52] U.S. Cl. ..... 285/4; 4/252 R; 138/96 R; 285/59; 285/DIG. 22

[58] Field of Search ..... 285/3, 58, 4, 59, 60, 285/56, DIG. 22; 4/252 R; 138/96 R, 89; 52/244

[56] References Cited

U.S. PATENT DOCUMENTS

| | | | |
|---|---|---|---|
| 2,202,147 | 5/1940 | Gerriets | 138/96 R X |
| 2,925,461 | 2/1960 | Anderson | 285/DIG. 22 X |
| 3,048,911 | 8/1962 | Almon | 138/89 X |
| 3,419,288 | 12/1968 | Logsdon | 285/58 |
| 3,643,267 | 2/1972 | Winter | 4/252 R |
| 3,654,965 | 4/1972 | Gramain | 285/4 X |
| 3,800,486 | 4/1974 | Harvey | 285/4 X |
| 3,823,744 | 7/1974 | Logsdon | 138/89 X |
| 3,866,950 | 2/1975 | Skoch et al. | 285/4 |
| 3,963,268 | 6/1976 | Widdicombe | 285/DIG. 22 X |
| 4,052,759 | 10/1977 | Hill | 285/58 X |

*Primary Examiner*—Thomas F. Callaghan
*Attorney, Agent, or Firm*—K. H. Boswell; Edward D. O'Brian

[57] ABSTRACT

A water closet protector stabilizer of the type used to permanently affix plastic soil pipe into concrete slabs and to provide protection against the infusion of wet concrete into the pipe during the pouring of the slab can be constructed utilizing a collar having a cylindrical section for mating with and attaching to the soil pipe and a flange attached to this collar which has a series of slots near the outer edge of the flange. A cover of a generally frustrum shape formed by a continuous wall has a series of fingers on the bottom most portion thereof. The cover is reversably attached to the collar by inserting the fingers into the slots on the flange. The cover has a top detachably mounted to the walls of the cover by a series of breakable bridgepoints. The top of the cover is composed of a flat disk having a series of sections mounted to each other by breakable bridgepoints. These sections can individually be removed to accommodate different sizes of mounting components which will be attached to the soil pipe after the concrete slab is poured.

10 Claims, 4 Drawing Figures

WATER CLOSET PROTECTOR STABILIZER

BACKGROUND OF THE INVENTION

The invention set forth in this specification pertains to a water closet protector stabilizer used to permanently affix plastic soil pipes into concrete slabs and also provides for protecting the pipe against infusion of wet concrete into the pipe during the pouring of the concrete slab. Further, the invention provides for a cavity in the concrete slab into which fits a portion of a closet mounting ring used to secure a water closet to the soil pipe.

In the past soil pipes of the type used to collect drainage from water closets were made of cast iron. The outside surface of the cast iron contained numerous cavities and bumps. When these pipes were embedded in concrete slabs, because the concrete tended to fill in the cavities and interlock with the bumps, this held the cast iron pipe firmly within the body of the concrete slab. Modern day plumbing utilizes plastic soil drain pipes. Because of the very nature of the plastic the outside surface of a plastic pipe is smooth and therefore presents no cavities or bumps which will interlock with the concrete and firmly affix the plastic pipe into the concrete slab. Because of this the plastic pipe tends to slip up and down within the concrete slab.

In my prior U.S. Pat. No. 3,419,288 granted Dec. 31, 1968, I described certain stabilizers which can be bonded to plastic pipe and anchor the pipe in a concrete slab. However, these flanges do not protect the pipe from infusion of concrete into the pipe during the pouring of the concrete slab, nor do they provide for any anchor points for fixtures which will be mounted to the pipe.

To attempt to overcome these disadvantages, I described in my prior U.S. Pat. No. 3,823,744 patented July 16, 1974, a pipe protector. However, this pipe protector could only be used on pipes of the exact size as the protector, thus requiring a multiplicity of such protectors for the various sizes of pipes in use. Further, this protector could easily become dislodged from the pipe prior to and during the pouring of the concrete slab resulting in concrete leakage under the protector. Additionally after the slab was poured the protector had to be removed from the slab which sometimes proved to be difficult and resulted in breakage of the surface of the slab around the protector. In removing this protector if it for any reason did not easily slide out of the concrete slab it required the expenditure of time by expensive laborers to remove the protector and due to the ever increasing cost of this labor this is prohibitive.

BRIEF SUMMARY OF THE INVENTION

It is believed that from the preceding discussion it is apparent that there is a need for new pipe stabilizer protectors. It is therefore a broad object of this invention to fulfill this need. It is an additional object to provide a pipe protector stabilizer which is easily manufactured and because the cost is ultimately borne by the consumer, is also economic to use.

In accordance with the present invention these and other objects and advantages will become apparent by providing a water closet protector stabilizer of the type used to secure a plastic soil pipe within the body of a concrete slab and to provide for a cavity in the slab for mounting components. The water closet protector stabilizer has a collar which has a cylindrical section which mates with and attaches to a soil pipe and a flange section projecting from the cylindrical section. The flange section has a series of slots and two passage holes. After mounting the collar to the pipe, the passage holes are provided with a bolt and a nut. A cover having a frustrum shape is placed over the top of the pipe and attached to the collar by the means of a series of fingers projecting from the lower edge of the cover which slip into and engage with the slots in the collar. The cover has a top portion mounted to the walls of the cover with a series of breakable bridgepoints. Further the top is composed of a series of sections also mounted to each other by a series of breakable bridgepoints. After the cover and collar are attached to the pipe and the cement slab poured, the appropriate sections in the top of the cover can be removed allowing the insertion of mounting components which are attached to the pipe. A water closet or other fixture is then attached to the mounting components. Since the outside diameter of the cover is smaller than the outside diameter of the flange when the cover is attached to the flange, a portion of the flange extends beyond the cover. This portion of the flange extending beyond the cover serves to lock both the water closet protector stabilizer and the soil pipe attached to it in the slab.

Figure 1:
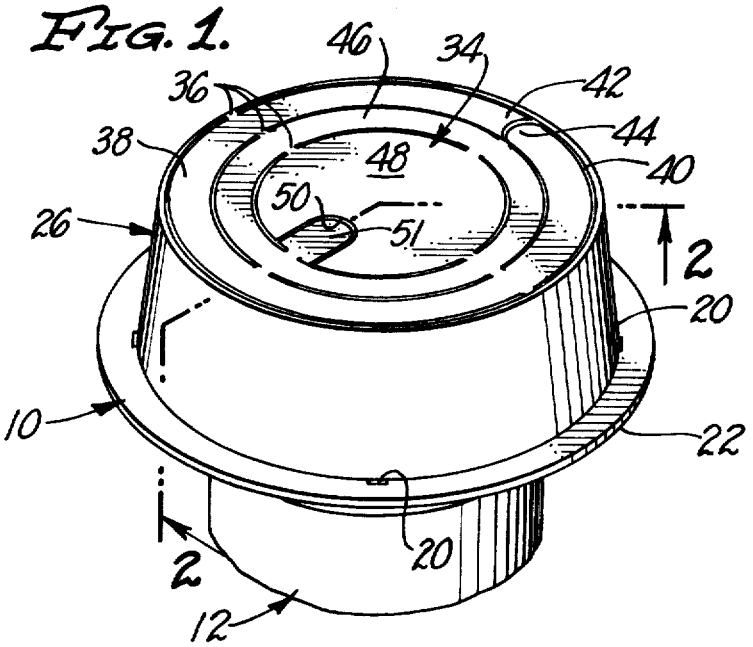
FIG. 1 is an isometric view of the presently preferred embodiment of a water closet protector stabilizer as attached to a plastic soil pipe prior to pouring a concrete slab in which the pipe will be imbedded.
Figure 2:
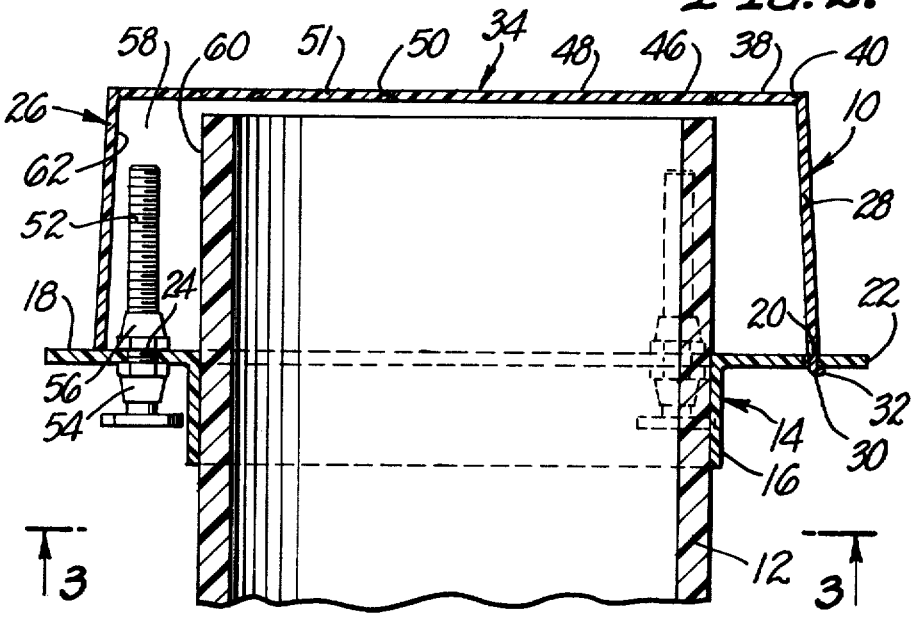
FIG. 2 is an elevational view in section of the water closet protector stabilizer shown in FIG. 1 taken at line 2—2.
Figure 3:
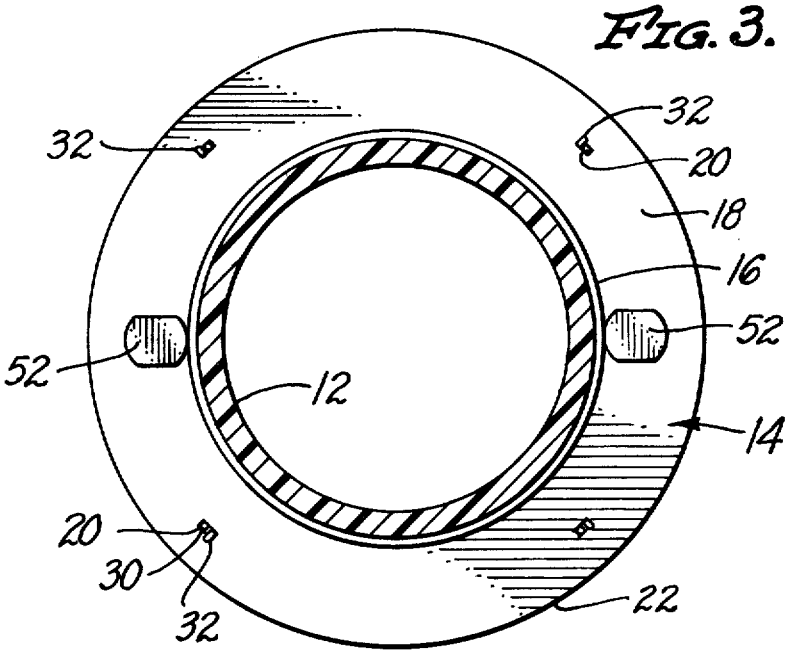
FIG. 3 is a bottom view of the water closet protector stabilizer taken at line 3—3 of FIG. 2.
Figure 4:
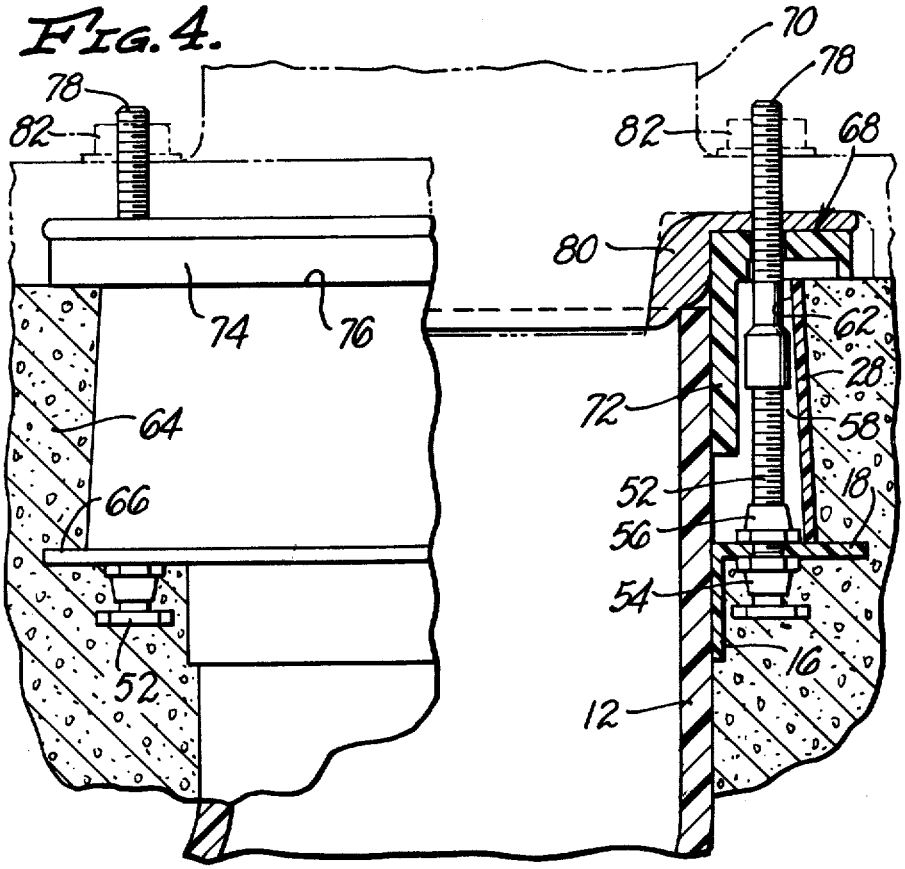
FIG. 4 is a side elevational view in partial section of the water closet protector stabilizer shown in the previous figures and a closet mounting ring attached thereto in preparation for mounting a water closet to the closet mounting ring.

The water closet protector stabilizer illustrated in the drawing is so constructed as to utilize certain essentially intangible concepts of the invention as set forth and defined in the appended claims. It will be realized that these concepts can be utilized within a variety of somewhat differently appearing and differently constructed structures through the use or exercise of routine design and engineering skill.

DETAILED DESCRIPTION

In the drawing there is shown a water closet protector stabilizer 10 of the present invention utilized in connection with a plastic soil drain pipe 12. A collar 14 is composed of a cylindrical section 16 and a flange 18 attached to the top of the cylindrical section and projecting perpendicular to the longitudinal axis of the cylindrical section 16. The cylindrical section 16 fits around the plastic soil pipe 12 and is joined to this pipe 12 with a suitable cement or solvent which is capable of adhering to or dissolving the plastic and forming a bond between the collar 14 and the pipe 12. Symmetrically staggered around the flange 18 are a series of small slots collectively identified by the numeral 20. Slots 20 are placed in the vicinity of the outside edge 22 of the flange 18 but not close to this edge. Flange 18 also has two passage holes collectively identified by the numeral 24 which are on opposite sides of the flange 18 and whose centers lie on an imaginary line through the center of the collar 14. The diameter of an imaginary circle going through passage holes 24 is smaller than the diameter of an imaginary circle passing through slots 20 such that passage holes 24 are closer than the slots 20 to the inside edge where the flange 18 meets the cylindrical section 16.

A cover 26 having a generally frustrum shape has an integral continuous wall 28 defining the surface of the frustrum. On the bottom most edge of wall 28 are a series of small fingers 30 which when cover 26 is mated with collar 14 fingers 30 project through slots 20. On the end of fingers 30 are dogs 32. When fingers 30 are inserted through slots 20 the dogs 32 reversably retain cover 26 on collar 14. Cover 26 has a top 34 which is demountably attached to wall 28. This attachment is achieved by a series of small, breakable bridgepoints collectively identified by the numeral 36. The top 34 is a flat disk and has four sections. An outside section ring 38 is incomplete and has a break 40 in its surface. Break 40 defines two ends 42 and 44 respectively in this outside ring 38. The two ends 42 and 44 are joined together by breakable bridgepoint also noted by numeral 36. Ring 46 is joined to ring 38 by a series of breakable bridgepoints also noted by numeral 36. The third section in top 34 is a disk 48 having a notch 50 therein. The fourth section is a tab 51 which fits into the notch 50 in disk 48. Disk 48 and tab 51 are joined to ring 46 by a series of breakable bridgepoints also noted by numeral 36.

A bolt 52 having a nut 54 is passed through passage hole 24 and secured thereon by a second nut 56. When collar 14 is attached to pipe 12 and cover 26 attached to collar 14 bolt 52 extends into the space or chamber 58 between the outside wall 60 of the pipe 12 and the inside wall 62 of cover 26.

During the initial construction stage of a structure, the soil pipe 12 is laid onto the sand used as the foundation of a concrete slab 64. The pipe 12 bends by use of an elbow (not separately numbered) and then projects upward and the collar 14 is attached to the pipe 12 near its uppermost projection. The bolts 52, and nuts 54 and 56 are attached and the cover 26 secured to the collar 14 by inserting the fingers 30 into the slots 20. The concrete slab 64 is then poured around the pipe 12 and the cover 26. The collar 14 and cover 26 are so placed on the pipe 12 that the top 34 of the cover 26 will be flush with the uppermost surface of the finished concrete slab 64.

The portion 66 of flange 18 extending beyond the perimeter of the bottom of cover 26 is locked into the concrete and permanently fixed in position when the concrete sets. Because soil pipe 12 is attached to collar 14 this also locks soil pipe 12 into a fixed position in the concrete slab 64. Additionally since cover 26 is frustrum shaped, cover 26 is also permanently fixed in the concrete slab 64. Further the head of bolt 52 is also locked into the concrete slab 64.

Depending on the size of the soil pipe 12 and the size of a closet mounting ring 68 fitting around the soil pipe 12, one or more of disk 48, ring 46 or ring 38 can be removed from the top 34 without disturbing the remaining rings. This is accomplished by pushing in tab 51 and breaking the bridgepoint 36 between tab 51 and disk 48 and ring 46. A finger of a plumber can then be inserted in the notch 50 left by tab 51 and disk 48 can be lifted away from ring 46 by breaking bridgepoints 36 between disk 48 and ring 46. Ring 46 can be removed from ring 38 and ring 38 can be removed from walls 28 in the same manner.

During construction of cover 16 the bridgepoints 36 between the components of top 34 and between top 34 and wall 28 are constructed to be strong enough to resist accidentally breaking of any of the bridgepoints 36 and the resulting detachment of any of the components 50, 48, 46 or 38 by spillage of concrete thereon; however, they are weak enough so that they can be removed as required in the later plumbing operations.

For final fitting of a water closet 70 a portion of which is shown in phantom lines in the drawing, a closet mounting ring 68 is coated on its inside surface with a solvent or suitable cement and inserted through an opening in the cover 26, said opening of the correct size having been formed by removal of one or more sections of top 34 as hereinbefore described and bonded to pipe 12. The tube portion 72 of closet mounting ring 68 fits around the outside of pipe 12 in the space or chamber 58 between the outside wall 60 of pipe 12 and the inside wall 62 of cover 26. The flange portion 74 of closet mounting ring 68 abuts against the uppermost perimeter 76 of wall 28. Screw extensions collectively identified by numeral 78 are screwed onto bolt 52. After placing an appropriate gasket 80 on the closet mounting ring 68, water closet 70 is attached by means of nuts 82 shown in phantom.

All of the components of the water closet protector stabilizer 10 herein described can be formed of ABS, PBC or other plastic suitable for plumbing construction as defined by local plumbing codes. As before noted, collar 14 is joined to pipe 12 by a solvent or cement suitable for use with the particular plastic which collar 14 is composed of. The use of such solvents or cements is known in the art.

Because of the unique construction of top 34 which has a series of removable sections, one size top can be utilized for a variety of different sized soil pipes 12. Additionally, because of the frustrum shape of these tops, these tops can be conveniently stacked and stored using a minimum of space. To utilize the described closet protector stabilizer for a variety of different sized soil pipes 12 it is only necessary to have several collars having different sized cylindrical tube openings which match the size of the pipes. Aside from the size of the cylindrical tube opening the remaining dimensions of the collar are standard allowing it to be used with the standard sized cover.

I claim:

1. A water closet protector stabilizer of the type used to secure a plastic soil pipe within the body of a concrete slab and to provide a cavity between the concrete slab and the pipe in which a portion of a closet mounting ring can be inserted and wherein said closet mounting ring is of the type having a tube portion fitting around said pipe and a flange portion attached to the top of said tube portion onto which a water closet abuts with and in conjunction with a gasket seals the flange portion the improvement which comprises:

collar means, said collar means having a cylindrical section thereof for mating with and attaching to said soil pipe and an annular flnage integrally attached to the top of said cylindrical section, said collar means having a closet retaining means, cover means, said cover means having an upstanding continuous integral wall, said wall defining a chamber within said cover means, said cover means having a top detachably connected to said upstanding wall, attaching means for connecting said cover means to said collar means.

2. A water closet protector stabilizer of claim 1 wherein:

said upstanding wall of said cover means forms a frustrum shaped surface having a bottom and a top opening, said top opening being of a smaller dimension than said bottom opening, said detachably connected top of said cover means integrally fitting with and detachably connecting to the upper perimeter of said upstanding wall of said cover means.

3. A water closet protector stabilizer of claim 1 wherein:

said upstanding wall of said cover means forms a frustrum shaped surface having a bottom and a top opening, said top opening being of a smaller dimension than said bottom opening, and said detachably connected top of said cover means integrally fitting with and detachably connecting to the upper perimeter of said upstanding wall of said cover means, said attaching means comprising in combination said annular flange having a plurality of symmetrically staggered slots and a plurality of symmetrically staggered fingers on the bottom portion of said upstanding wall at least two of said fingers having a dog on the end thereof such that said fingers fit into said slots and said dogs demountably attach said cover means to said collar means.

4. A water closet protector stabilizer of claim 3 wherein:

said slots in said annular flange are proximal to but not touching the outer edge of said flange.

5. A water closet protector stabilizer of claim 3 including:

said closet retaining means comprising in combination said annular flange having two passage holes, two bolts, and at least two nuts, said passage holes being on opposite sides of said annular flange on an imaginary line passing through the center of said annular flange, said bolts passing through said passage holes and secured there by said nuts, said holes in said annular flange being positioned such that when said cover means is attached to said collar means, said bolts pass through said bottom opening in said cover means and project from said annular flange within the chamber of said cover means toward the top of said cover means.

6. A water closet protector stabilizer of claim 3 including:

said top and said upstanding wall detachably connected by a plurality of small, breakable bridgepoints between said top and said wall.

7. A water closet protector stabilizer of claim 6 wherein:

said detachably connected top comprises a flat disk having at least two sections, said sections fitting one within the other and said sections detachably connected by at least one small breakable bridgepoint between said sections.

8. A water closet protector stabilizer of claim 7 wherein:

the detachably connected top comprises a flat disk having four sections, the first section being a ring having a break therein, the two ends of the ring formed by the break abutting adjacent to each other, the second section being a ring, the outer edge of the second section ring abutting adjacent to the inner edge of the first section ring, the third section being a disk having a notch in one side thereof, the outer edge of said disk abutting adjacent to the inner edge of said section ring, the fourth section being a tab fitting in part into and abutting against the edge of said notch in said third section disk and in the remaining part fitting against and abutting against the inner edge of said second section ring and said first, second, third and fourth sections connected respectively by a plurality of small, breakable bridgepoints between said sections.

9. A water closet protector stabilizer of the type used to secure a plastic soil pipe within the body of a concrete slab and to provide a cavity between the concrete slab and the pipe in which a portion of a closet mounting ring can be inserted and wherein said closet mounting ring is of the type having a tube portion fitting around said pipe and a flange portion attached to the top of said tube portion onto which a water closet abuts with and in conjuntion with a gasket seals against the flange portion, the improvement which comprises:

collar means, said collar means having a cylindrical section for mating with and attaching to said soil pipe and an annular flange integrally attached to the top of said cylindrical section, cover means, said cover means having an upstanding continuous integral wall, said wall defining a chamber within said cover means, said cover means having a top detachably connected to said upstanding wall, said upstanding wall of said cover means forming a frustrum shaped surface having a bottom and a top opening, said top opening being of a smaller dimension than said bottom opening, and said detachably connected top of said cover means integrally fitting with and detachably connecting to the upper perimeter of said upstanding wall of said cover means by a plurality of small, breakable bridgepoints between said top and said wall, said detachably connected top having a flat disk, said flat disk having four sections, the first section being a ring having a break therein, the two ends of the ring formed by the break abutting adjacent to each other, the second section being a ring, the outer edge of the second section ring abutting adjacent to the inner edge of the first section ring, the third section being a disk having a notch in one side thereof, the outer edge of said disk abutting adjacent to the inner edge of said section ring, the fourth section being a tab fitting in part into and abutting against the edge of said notch in said third section disk and in the remaining part fitting against and abutting against the inner edge of said second section ring and said first, second, third and fourth sections connected respectively by a plurality of small, breakable bridgepoints between said sections, attaching means for connecting said cover means to said collar means which comprises said annular flange having a plurality of symmetrically staggered slots proximal to but not touching the outer edge of said flange, and said cover having a plurality of symmetrically staggered fingers on the bottom portion of said upstanding wall at least two of said fingers having a dog on the end thereof such that said fingers fit into said slots and said dogs demountably attach said cover means to said collar means, said collar means having a concrete holding means, said concrete holding means comprising the portion of said flange extending between said slots and the outer edge of said flange.

10. A water closet protector stabilizer of claim 9 including:

said collar means having closet retaining means, said closet retaining means comprising in combination said annular flange having two passage holes, two bolts and at least two nuts, said passage holes being on opposite sides of said annular flange on an imaginary line passing through the center of said annular flange, said bolts passing through said passage holes and secured there by said nuts, said holes in said annular flange being positioned such that when said cover means is attached to said collar means, said bolts pass through said bottom opening in said cover means and project from said annular flange within the chamber of said cover means toward the top of said cover means.

* * * * *